US008984721B2

(12) United States Patent
Hallett

(10) Patent No.: US 8,984,721 B2
(45) Date of Patent: Mar. 24, 2015

(54) STRAP SHOCK ABSORBER

(75) Inventor: Mark B. Hallett, Appleton, WI (US)

(73) Assignee: Concussion Resources, LLC, Appleton, WI (US)

( * ) Notice: Subject to any disclaimer, the term of this patent is extended or adjusted under 35 U.S.C. 154(b) by 0 days.

(21) Appl. No.: 13/342,165

(22) Filed: Jan. 2, 2012

(65) Prior Publication Data

US 2012/0167283 A1 Jul. 5, 2012

Related U.S. Application Data

(60) Provisional application No. 61/428,958, filed on Dec. 31, 2010.

(51) Int. Cl.
*A43C 11/00* (2006.01)
*A42B 3/08* (2006.01)

(52) U.S. Cl.
CPC ..... *A42B 3/08* (2013.01); *Y10T 24/2164* (2013.01)
USPC ..... 24/71.1

(58) Field of Classification Search
CPC ..... A62B 35/04; A42B 3/08; B60D 1/82; B62B 2021/005; F16F 9/0418
USPC ..... 24/300, 301, 198, 200, 68 F, 129 D, 24/129 A, 129 B, 71.1; 267/71, 151, 74, 69; 2/421, 425
See application file for complete search history.

(56) References Cited

U.S. PATENT DOCUMENTS 1,486,239 A 3/1924 Garland
2,443,191 A * 6/1948 Miller ..... 297/471
2,878,013 A * 3/1959 Piodi ..... 267/69
3,187,342 A 6/1965 Aileo
3,444,957 A 5/1969 Ervin, Jr.
(Continued)

FOREIGN PATENT DOCUMENTS

CA 2093568 5/2001
EP 0673810 9/1995
(Continued)

OTHER PUBLICATIONS

International Search Report mailed Aug. 31, 2012 for PCT/US2012/020005.
(Continued)

*Primary Examiner* — Robert J Sandy
*Assistant Examiner* — Matthew Sullivan
(74) *Attorney, Agent, or Firm* — DeWitt Ross & Stevens S.C.; Joseph T. Miotke

(57) ABSTRACT

A system with a shock absorbing device shaped to fit onto straps of any size, introducing low amplitude shock absorption into the strap fixation system without compromising the fixation. The present device essentially takes up a small amount of slack in the strap and stores it within a serpentine course through a body made of a deformable material. In the event that increased and potentially damaging loads are experienced, the Strap Shock-Absorber deforms, but the fixation never exceeds the length of the strap itself. With potential applications ranging from chin straps to industrial straps, working in one or two dimensions, this device can reduce damaging force transmission to protect valuable but vulnerable structures. The deformation of the device may be either elastic or plastic, or may be a combination of both.

13 Claims, 8 Drawing Sheets

(56) References Cited

U.S. PATENT DOCUMENTS

| | | | | |
|---|---|---|---|---|
| 3,804,698 | A | 4/1974 | Kinloch | |
| 3,817,507 | A * | 6/1974 | Derman et al. | 267/74 |
| 4,100,996 | A | 7/1978 | Sharp | |
| 4,192,493 | A * | 3/1980 | Koughan | 267/74 |
| 4,253,544 | A | 3/1981 | Dalmaso | |
| 4,446,944 | A * | 5/1984 | Forrest et al. | 182/3 |
| 4,757,979 | A * | 7/1988 | Essex | 267/71 |
| 5,090,503 | A | 2/1992 | Bell | |
| 5,174,410 | A | 12/1992 | Casebolt | |
| 5,259,096 | A | 11/1993 | Grant | |
| 5,450,995 | A | 9/1995 | Perrin | |
| 5,598,900 | A | 2/1997 | O'Rourke | |
| 5,607,092 | A | 3/1997 | Alexander | |
| 5,774,901 | A | 7/1998 | Minami | |
| 6,007,024 | A * | 12/1999 | Stephan | 244/118.1 |
| 6,070,272 | A | 6/2000 | Chiang | |
| 6,481,024 | B1 | 11/2002 | Grant | |
| 7,188,585 | B1 | 3/2007 | Carter | |
| 7,258,516 | B1 * | 8/2007 | Collins et al. | 410/99 |
| 7,870,617 | B2 | 1/2011 | Butler | |
| 8,056,151 | B2 | 11/2011 | Bologna et al. | |
| 8,381,365 | B2 * | 2/2013 | Elia et al. | 24/169 |
| 2003/0001378 | A1 | 1/2003 | Kim et al. | |
| 2003/0056338 | A1 * | 3/2003 | Anscher | 24/71.1 |
| 2003/0106187 | A1 | 6/2003 | Jackson et al. | |
| 2004/0003452 | A1 | 1/2004 | Schiebl | |
| 2004/0098793 | A1 | 5/2004 | Gershenson | |
| 2005/0258205 | A1 * | 11/2005 | French | 224/264 |
| 2007/0261213 | A1 | 11/2007 | Nolan et al. | |
| 2008/0185409 | A1 | 8/2008 | Kellenberger | |
| 2010/0052402 | A1 | 3/2010 | Berger et al. | |
| 2010/0293759 | A1 * | 11/2010 | Wada | 24/265 EC |
| 2010/0319109 | A1 * | 12/2010 | Field | 2/421 |
| 2011/0187032 | A1 * | 8/2011 | Bohman | 267/74 |
| 2013/0277519 | A1 * | 10/2013 | Poldmaa | 248/237 |

FOREIGN PATENT DOCUMENTS

| | | |
|---|---|---|
| GB | 1287698 | 3/1973 |
| GB | 1447902 | 9/1976 |

OTHER PUBLICATIONS

PCT/US2012/020005 International Preliminary Report on Patentability with Annexes dated Jul. 26, 2013 and Amendment filed by Applicant dated Nov. 28, 2012 (11 pages total).

* cited by examiner

STRAP SHOCK ABSORBER

CROSS-REFERENCE TO RELATED APPLICATION

The present application claims priority to U.S. Provisional Application Ser. No. 61/428958, filed on Dec. 31, 2010, the disclosure of which is incorporated herein by reference in its entirety.

BACKGROUND OF THE INVENTION

This disclosure pertains to sports, transportation, or any other commercial or industrial activity in which inelastic straps of various widths are tightened to sustain fixed loads, that predictably increase during the activity, causing brief intermittent periods of increased and potentially damaging force to be transmitted to that which the straps affix. The straps necessarily must continue to connect the two ends to which they are attached after the force has normalized, although in many applications, if the strap were to lengthen slightly during the period of maximal force, then return to its previous length, the purpose would not be compromised.

This disclosure was first conceived to provide a shock-absorbing function for the chin straps of American football players, to minimize the concussive forces transmitted through the helmet to the player's brain. Improvements to the conventional approaches to provide secure fastening helmets while allowing attenuation of shock transmitted through the helmets are desirable.

The concept extends, however, to any strap that affixes damageable entities or property to solid structures (e.g. property carried on car tops or trailers) that, because of vibration or variable force, could damage those entities unless protected by a strap that has limited amount of elasticity without compromising fixation.

BRIEF SUMMARY OF THE INVENTION

The present disclosure may be embodied in a ladder-shaped rubber, plastic, or other elastic material device through which a strap is inserted that, by virtue of the strap's serpentine path through the elastic device, provides shock-absorption without loss of secure fixation. The design concept remains constant, but the width, length, depth, and contour of the ladder-shaped device can be modified to adapt for the width and thickness of the strap based upon the desired amount of shock attenuation and maximum tolerable strap lengthening for the particular application.

For some applications, such as helmet chin straps, the device would be free in space, constrained and its position determined only by the path of the strap. For other applications, the device's surfaces may be designed to lay directly adjacent to the cargo that the strap is holding, which would lessen the chance that the strap would slip or otherwise damage the surface of the cargo, in addition to the function of shock absorption. Finally, if the device was made of moldable material, this ladder-shaped device could be pre-molded into 90 degree angles or curves for specific applications, such as moving furniture or refrigerators with a hand dolly.

Other potential construction or industrial applications of this device include using it to suspend pipes or ceiling-suspended machinery in earthquake- or severe weather-prone regions, and it could even be adapted for use with metal suspension/fixation straps.

BRIEF DESCRIPTION OF THE SEVERAL VIEWS OF THE DRAWINGS

The accompanying drawing figures, which are incorporated in and constitute a part of the description, illustrate several aspects of the invention and together with the description, serve to explain the principles of the invention. A brief description of the figures is as follows.

DETAILED DESCRIPTION OF THE INVENTION

Figures 1, 2, 3, 4, 5, 6, 7, 8:
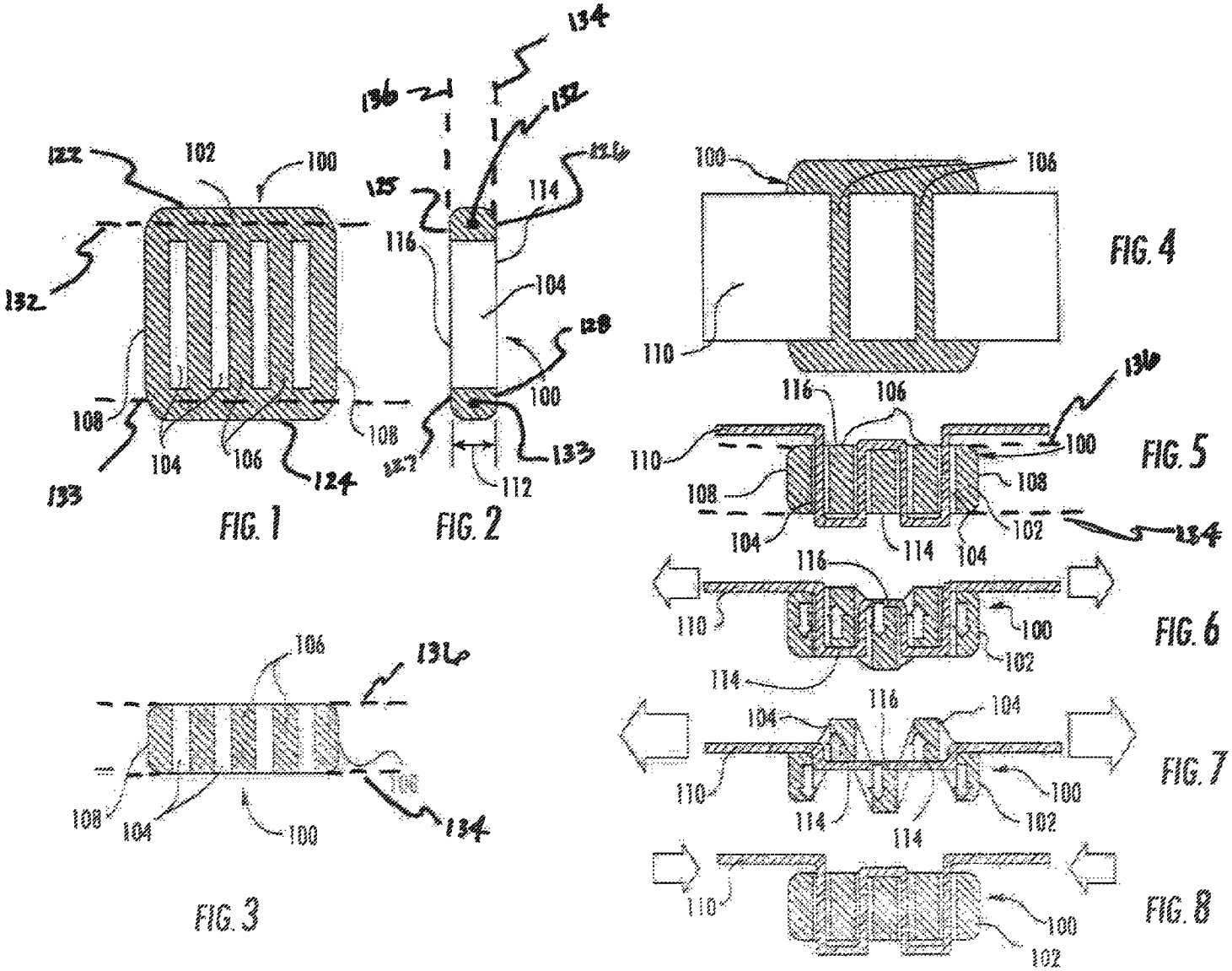
FIG. 1 is a top view of a shock absorbing device according to the present disclosure.
FIG. 2 is an end cross-sectional view of the shock absorbing device of FIG. 1.
FIG. 3 is a side cross-sectional view of the shock absorbing device of FIG. 1
FIG. 4 is a top view of the shock absorbing device of FIG. 1 with a strap extending through openings in the device.
FIG. 5 is a side cross-sectional view of the shock absorbing device and strap of FIG. 4 with little or no tension being exerted on the strap.
FIG. 6 is a side cross-sectional view of the shock absorbing device and strap of FIG. 5 with more tension being exerted on the strap.
FIG. 7 is a side cross-sectional view of the shock absorbing device and strap of FIG. 6 with more tension being exerted on the strap.
FIG. 8 is a side cross-sectional view of the shock absorbing device and strap of FIG. 7 with the tension on the strap released and the shock absorbing device returning to its original shape.
Figure 9:
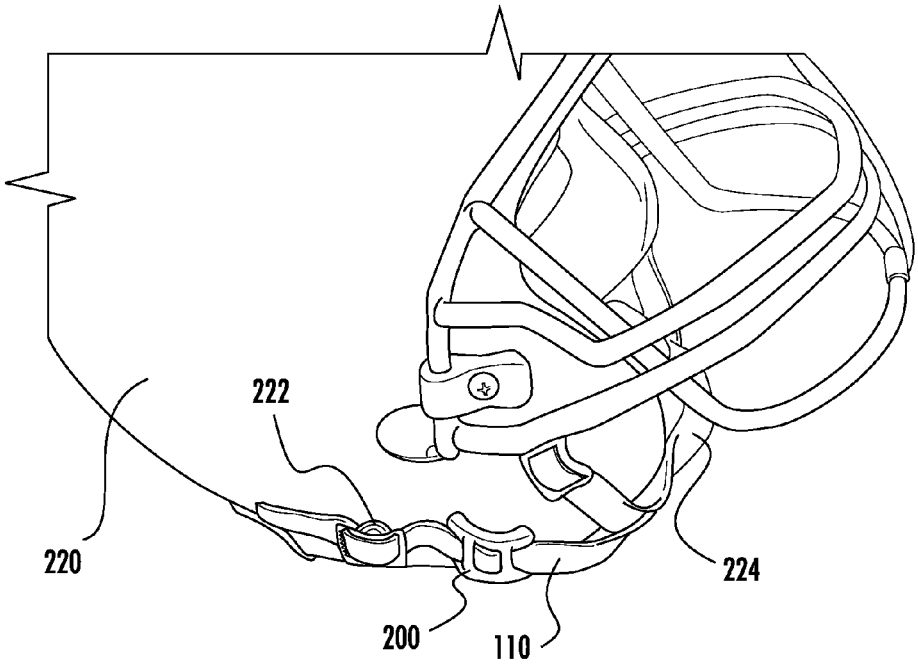
FIG. 9 is a first photographic oblique side view of an American football helmet including a chin strap which has been extended through a shock absorbing device according to the present disclosure.
Figure 10:
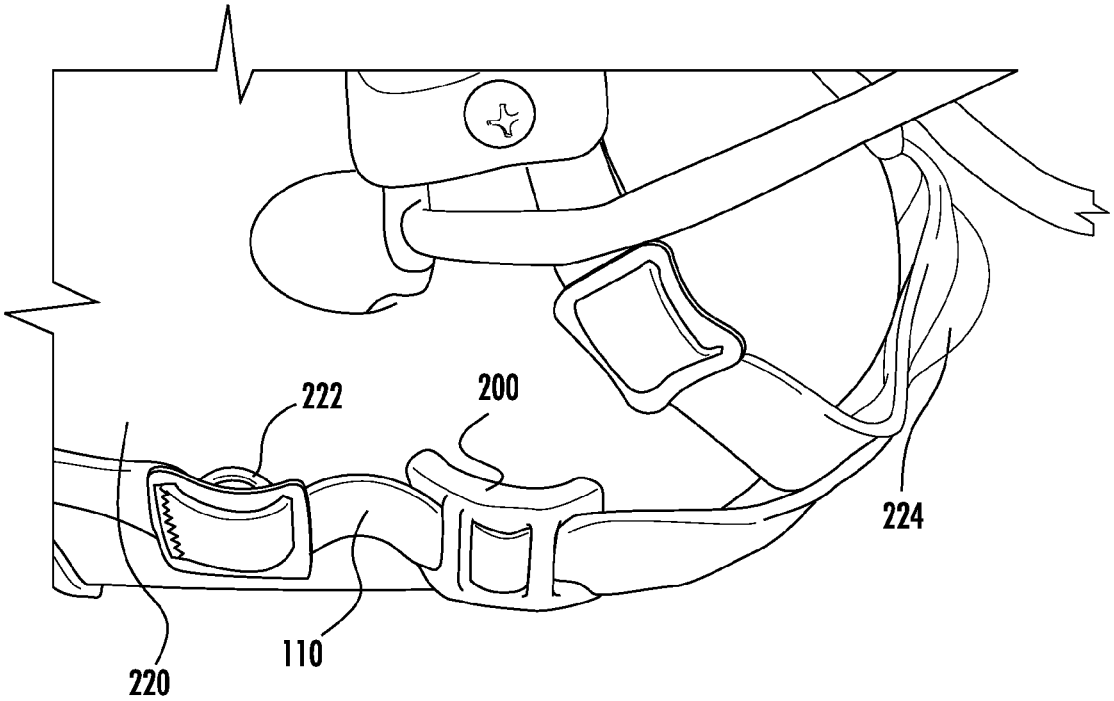
FIG. 10 is a second photographic oblique side view of the American football helmet of FIG. 9.
Figure 11:
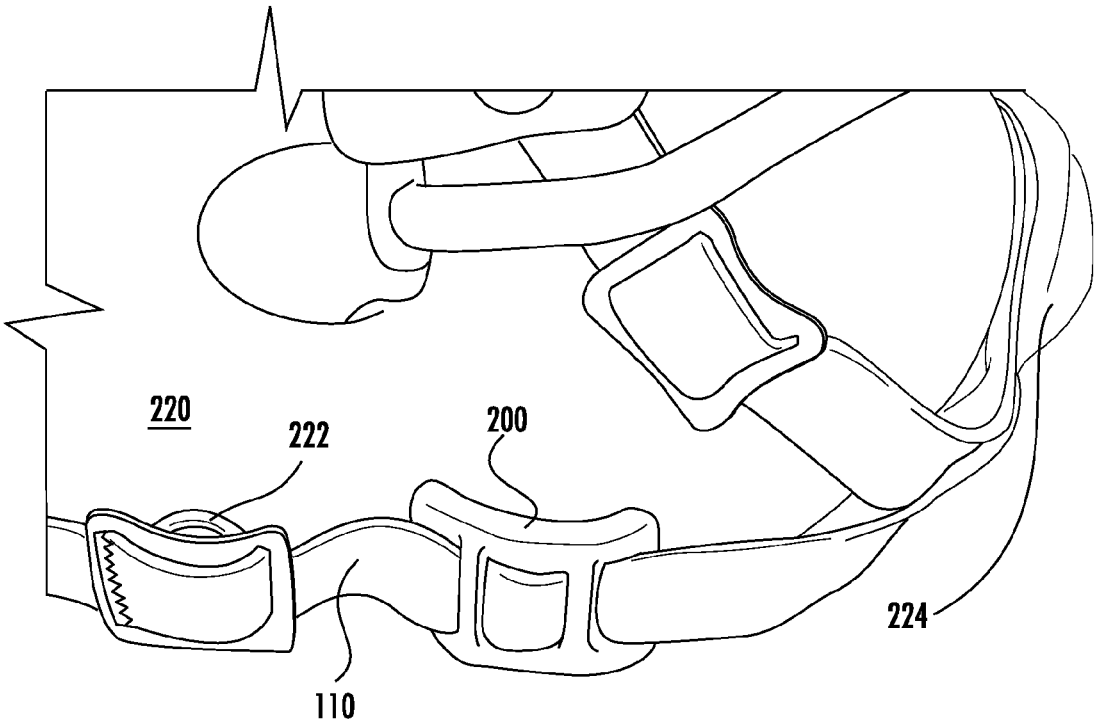
FIG. 11 is a third photographic oblique side view of the American football helmet including of FIG. 9.
Figure 12:
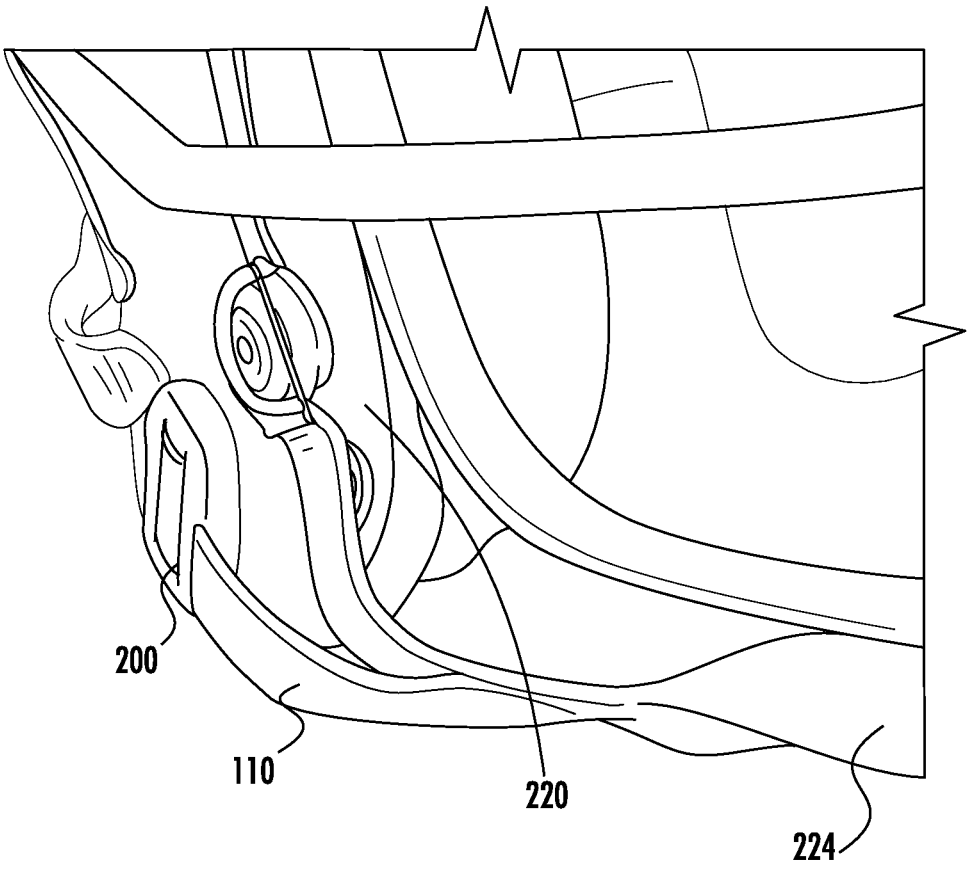
FIG. 12 is a photographic oblique front view of the American football helmet including of FIG. 9.

Reference now to FIGS. 1 to 3, a shock absorbing device 100 according to the present discloser may include a body 102 with a plurality of openings 104 separated by ribs 106 and a pair of end ribs 108. body 102 may be molded from an appropriate material as described below or maybe machined or otherwise formed from a larger continuous piece. Body 102 of device 100 also has a thickness 112. Each rib may have opposing outer surfaces 114 and 116. Body 102 has a first lateral side 122 and a second lateral side 124. First lateral side 122 has a first central axis 132, and second lateral side 124 has a second central axis 133. A first outer surface is defined by a first plane 136 that generally intersects a top surface 125 of first lateral side 122 and a top surface 127 of second lateral side 124. A second outer surface is defined by a second plane 134 that generally intersects a bottom surface 126 of first lateral side 122 and a bottom surface 128 of second lateral side 124.

Referring now to FIGS. 4 and 5, a strap 110 extends through openings 104 and weaves about ribs 106 and end ribs 108. As shown in FIGS. 4 and 5, no significant tension is being exerted on strap 110 and device 100 is in a relaxed or non-deformed state. In this state, the outer surfaces 114 and 116 of adjacent ribs are generally aligned with each other. Additionally in this state, outer surfaces 116 are generally coplanar wit body 100's first outer surface defined by first plane 136, and outer surfaces 114 are generally coplanar with body 100's second outer surface defined by second plane 134.

Referring now to FIG. 6, an initial load or tension is being exerted on strap 110, an indicated by the arrows at either end of the strap. In response to this load, the outer surfaces of ribs about which the strap extends are being drawn toward to the opposing surface of the adjacent ribs. This opposing displacement of the outer surfaces of adjacent ribs 104, combined with the thickness 112 of device 100, permits an elongation of strap 110 in response to the tension. The characteristics of the material from which body 102 of device 100 is made may be selected to provide a degree of resistance to this deformation or displacement of ribs 104 in response to a particular load to which the strap may be subjected. This degree of resistance will in turn provide some attenuation of any sudden loading of the strap. The arrows superimposed on body 102 indicate the direction that each rib may be displaced based on the load on strap 110.

FIG. 7 illustrates device 100 subjected to a greater load than FIG. 6, with a greater deflection or displacement of ribs shown. At this point, the maximum load that device 100 may be able to assist in the attenuation of has nearly been reached. This is a nearly a fully tensioned or deflected state for device 100. Very little additional deflection of ribs 104 is possible and strap 110 makes nearly a straight path through device 100.

FIG. 8 illustrates device 100 with the load on strap 110 relaxed. For some applications of device 100, it is desirable to have the device able to resist multiple consecutive loadings. If the selection of materials for device 100 has been appropriately made, device 100 will preferably have been operating in an elastic deformation load range even in the fully deflected state shown in FIG. 7 and will be able to return to the fully relaxed state shown in FIGS. 5 and 8. For other applications, it may be desirable that device 100 only be useful in resisting one loading and then remain in the fully deflected state after the loading. For these applications, selection of the material for body 102 of device 100 should be such that the device will preferably be operating in the plastic deformation range for the material. It is also anticipated that some embodiments of a device according to the present disclosure may be able to resist smaller loads with the body deflecting in the elastic range and returning to the relaxed state but when subjected to greater loads, the body may be forced into plastic deformation and will remain in a fully or partially deflected state after the load is removed. The post load condition may serve to a quick visual indicator of the degree of load to which the strap was exposed.

Device 200 as shown in photographic FIGS. 9 to 12 is configured for use in a strap 110 used on an American football helmet 220 and extending between a point of attachment 222 and a chin cup 224, and is made of a suitable material for the amount of shock absorption or attenuation desired for this application. The number of openings 104 and corresponding number of ribs 106, along with the nature of the material and the thickness 112 of the material of body 102, may be specified based on the expected load applied to the strap. The selection of different materials based on the nature of deformation as discussed above may also apply for this particular application. Ordinary contact and forces may result in no lasting deformation of the device but a significant blow may result in a visible permanent deformation and provide a quick indication to a coach or trainer.

The present disclosure may be embodied in a device that may consist of a molded body, for many purposes rectangular in shape and molded from material such as but not limited to rubber, into which may be cut or molded a series of parallel slots. The slots are preferably sized to accommodate different strap widths and thicknesses, with the overall size of the slots and the device itself increasing in size to accommodate larger straps. Alternatively, in some applications where the device may be desirably moved between different straps or repositioned along the length of a strap of varying dimensions, the slots may be sized to receive the largest anticipated strap size or portion thereof. The material, shape, length, and width of the body and number of slots would determine its shock absorptive characteristics, with larger, thicker, and more rounded structures requiring more imposed load prior to elastic deformation.

For other applications, a molded body according to the present disclosure would be curved or angled in shape, with parallel slots cut or molded into the device to serve the purposes above. In some applications, the surface of the device may be molded to include raised ridges or other adaptations that would protect surfaces and corners of the cargo that is secured by the strap and device assembly. It is anticipated that the device may be adapted to conform to the shape of the object to be protected, such as a corner, edge or surface break to secure the strap and the device in place.

Devices configured according to the present disclosure may be assembled with the straps either during the manufacturing process of the strap, especially if the strap contained fixed hooks or other structures at the end, or post-market, applied by the end user to adapt existing straps for improved use.

It is anticipated that the present disclosure may be adapted for use in industrial settings for use where a pipe or other device may be desirably held in a specific place but also allowed some range of movement in response to outside forces. For example, in a factory, a conduit may be suspended the ceiling at a specific location to provide a path for the movement of material within the facility. It is preferable that the conduit remain in a fixed location with respect to other equipment within the facility. However, if the building is subjected to a large shock, such as but not limited to, an earthquake, it may be desirable that the conduit be able to move in response to the shock loading and then return to its intended location.

Devices according to the present disclosure may be added into the suspension framework supporting the conduit and configured with a yield load above the highest normal operating loading. When the conduit is subjected to a larger loading in an unexpected event, the device would yield, allowing the conduit a greater range of movement to attenuate the shock and avoid excessive damage to the conduit. When the shock load dissipates, the device, being made preferably of a resilient deformable material, should return to its original shape and thus return the conduit to its desired fixed location.

Figure 13:
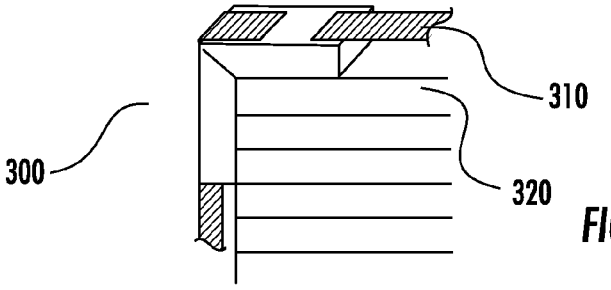
FIG. 13 is a perspective view an alternative embodiment of shock absorbing device according to the present disclosure included as part of a load securing strap for holding cargo or similar materials.
Figure 14:
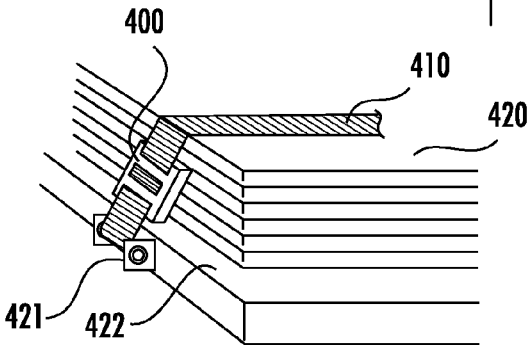
FIG. 14 is a perspective view of a second alternative embodiment of a shock absorbing device according to the present disclosure included as part of a load securing strap for holding cargo or similar materials.
Figure 15:
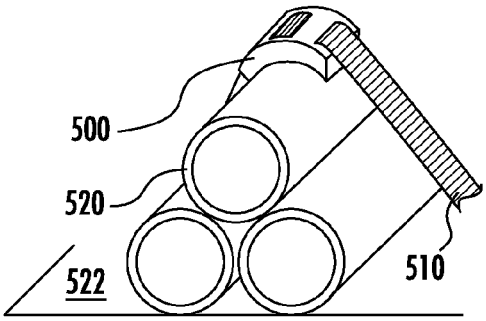
FIG. 15 is a perspective view of a third alternative embodiment of a shock absorbing device according to the present disclosure included as part of a load securing strap for holding rounded cargo or similar materials.

Referring now to FIGS. 13 to 15, it is anticipated that shock absorbing devices according to the present disclosure may be used as part of load or cargo securement systems. Such securement systems may allow loads to be securely attached to a transport of some sort while permitting shock loads occurring during transport to be attenuated without being transmitted to the load through the straps and possibly damaging the load. Such alternative embodiments as described below may be configured generally as described above to be included along a load securing strap.

Figure 18:
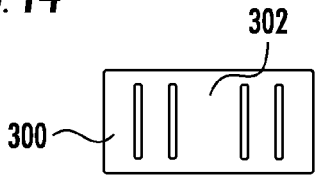
FIG. 18 is a top view of the shock absorbing device of FIG. 13.
Figure 19:
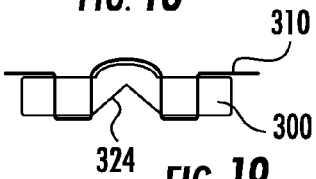
FIG. 19 is a side cross-sectional view of the shock absorbing device of FIG. 18, with a strap extending through openings in the device.
Figure 21:
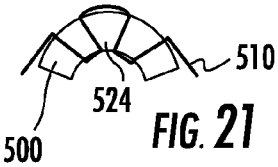
FIG. 21 is a side cross-sectional view of the shock absorbing device of FIG. 20, with a strap extending through openings in the device.

FIG. 13 illustrates a load securing strap 310 including a shock absorbing device 300 that it configured to fit about and secure a sharply angled corner of a load 320. Device 300 may thus absorb forces transmitted to either end of strap 310 and protect the corner of load 320. FIGS. 18 and 19 further illustrate device 300 which may include a Vee shaped or similar recess 324 in one side of a central portion of a body 302 of the device to more closely match the shape of the corner of load 320 to be protected.

Figure 16:
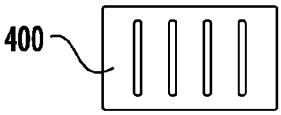
FIG. 16 is a top view of the shock absorbing device of FIG. 14.
Figure 17:
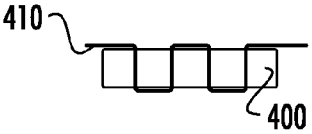
FIG. 17 is a side cross-sectional view of the shock absorbing device of FIG. 16, with a strap extending through openings in the device.

FIG. 14 illustrates a load securing strap 410 with a shock absorbing device 400 positioned between a load 420 and an anchor 421 of a transport 422. FIGS. 16 and 17 illustrate device 400 as being similarly configured to the device shown in FIGS. 4 and 5, above, with strap 410 extending through openings in the device.

Figure 20:
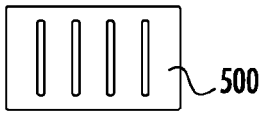
FIG. 20 is a top view of the shock absorbing device of FIG. 15.

FIG. 15 illustrates a load securing strap 510 with a shock absorbing device 500 positioned along a top of a rounded load 520 to secure the load to transport 522. FIGS. 20 and **2*i* illustrate device 500 with a curved inner surface 524 to more closely conform to the rounded shape of load 520**.

Figure 22:
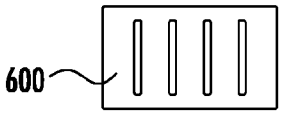
FIG. 22 is a top view of a fourth alternative embodiment of a shock absorbing device according to the present disclosure, with the device having a curved upper surface.
Figure 23:
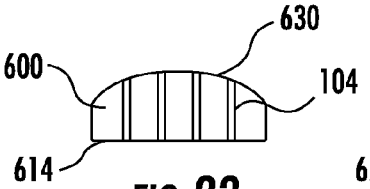
FIG. 23 is a side cross-sectional view of the shock absorbing device of FIG. 22.

FIGS. 22 and 23 illustrate a further embodiment of a shock absorbing device 600 according to the present disclosure. Device 600 includes an upper curved surface 630 opposite a lower generally planar surface 614. Openings 104 extend between the upper and lower surfaces through device 600 generally perpendicular to planar surface 614 to upper curved surface 630.

Figure 24:
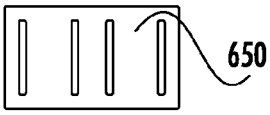
FIG. 24 is a top view of a fifth alternative embodiment of a shock absorbing device according to the present disclosure, with the device having a curved upper surface.
Figure 25:
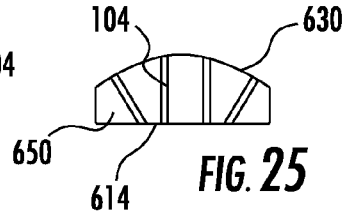
FIG. 25 is a side cross-sectional view of the shock absorbing device of FIG. 24.

FIGS. 24 and 25 illustrate a similar alternative embodiment of a shock absorbing device 650 according to the present disclosure. Like device 600, device 650 includes upper curved surface 630 and opposite lower generally planar surface 614. However, in device 650, openings 104 extend between the upper and lower surfaces through device 650 generally perpendicular to upper curved surface 630.

Figure 26:
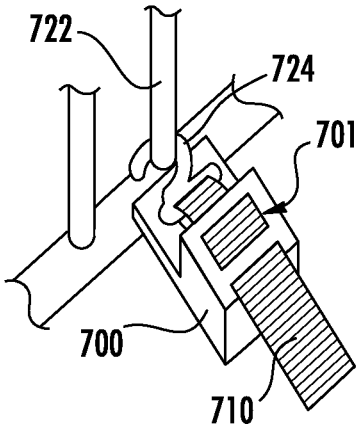
FIG. 26 is a perspective view of a sixth alternative embodiment of a shock absorbing device according to the present disclosure included as part of a load securing strap for holding cargo or similar materials.
Figure 27:
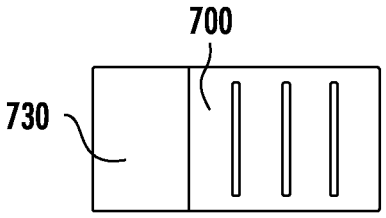
FIG. 27 is a top view of the shock absorbing device of FIG. 26.
Figure 28:
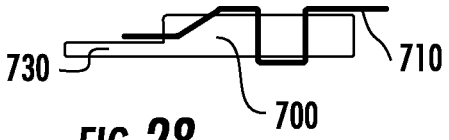
FIG. 28 is a side cross-sectional view of the shock absorbing device of FIG. 27, with a strap extending openings in the device.

Referring now to FIG. 26, a further alternative embodiment of a shock absorbing device 700 as part of a load securing system 701 is shown. A strap 710 extends through device 700 and may terminate a hook 724 or other element for engaging a corresponding post 722 or element of a transport to which a load may need to be secured. FIGS. 27 and 28 illustrate device 700 which may be configured with a protective flange 730 to prevent the strap from engaging an underlying surface. This may prevent the strap from being damaged by some objects beneath the flange or may prevent the strap from damaging something lying beneath the flange.

Figure 29:
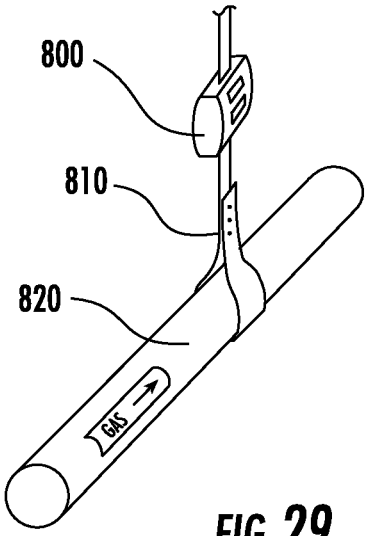
FIG. 29 is a perspective view of a seventh alternative embodiment of a shock absorbing device according to the present disclosure configured for use with a strap supporting a suspended pipe.
Figure 30:
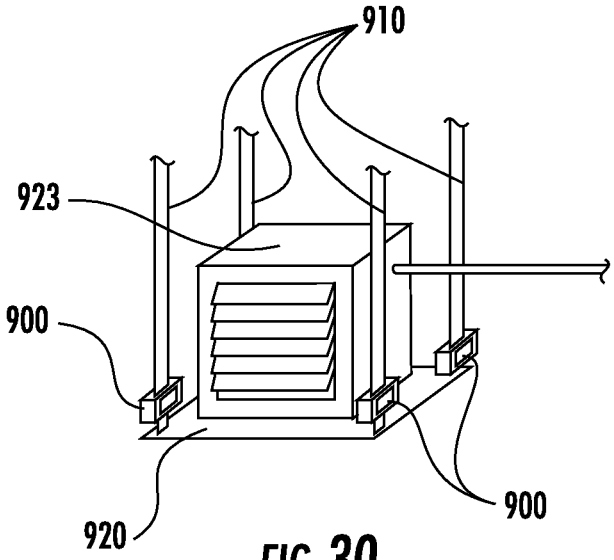
FIG. 30 is a perspective view of an eighth alternative embodiment of a plurality of shock absorbing devices according to the present disclosure configured for use with a plurality of straps supporting a suspended pipe.

Referring now to FIG. 29, a further embodiment of a shock absorbing device 800 according to the present disclosure has a strap extending through it to support a pipe 820. Referring now also to FIG. 30, a plurality of shock absorbing devices 900 are included with a plurality of straps 910 that are used to support a suspended platform 920 on which an element of industrial machinery 923 may be positioned. It may be desirable to have suspended elements within a facility be provided with some degree of shock load attenuation. This would prevent loads affecting the structure or the facility from being transmitted directly to the suspended elements. his more flexible suspension may be beneficial in ensuring that suspended elements are not disconnected from other associated equipment when the structure is subjected to some movement or loading.

Figure 32:
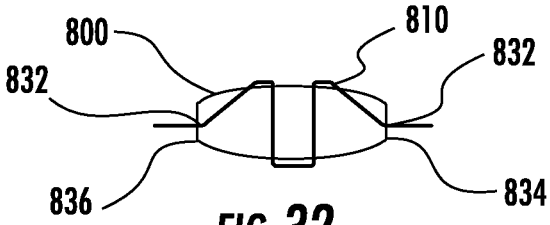
FIG. 32 is a side cross-sectional view of the shock absorbing device of FIG. 31 with a strap extending through openings in device and exiting the device through openings in opposing ends of the device.
Figure 31:
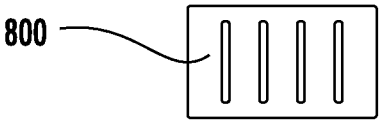
FIG. 31 is a top view of the shock absorbing device of FIG. 29.
Figure 33:
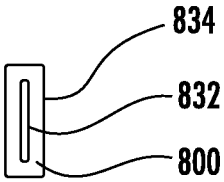
FIG. 33 is an end view of the shock absorbing device of FIG. 31.

FIGS. 31 to 33 illustrate the shock absorbing device 800 of FIG. 29 as including a pair of opposing ends 834 and 836 on which may be formed openings 832 through which strap 810 may extend. This permits the exit of strap 810 from device 800 to be more centrally located in the ends.

Figure 34:
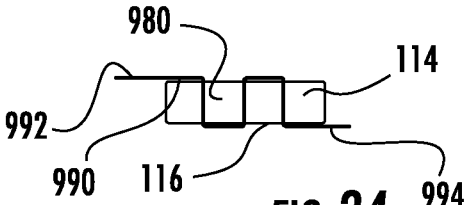
FIG. 34 is a side cross-sectional view of a ninth alternative embodiment of a shock absorbing device according to the present disclosure.

FIG. 34 illustrates a further embodiment of a sock absorbing device 980 according to the present disclosure, with a satrap 990 extending through openings in the device. The number of openings is configured so that a first end 992 of strap 990 extends from the device adjacent a first side 114 of device 980 while a second end 994 of strap 990 exits adjacent opposite 116 of device 980.

These last two embodiments illustrate possible alternative configurations for devices according to the present disclosure that will permit the strap extending through a shock absorbing device to exit from the device as needed for a particular use. It is anticipated that other configurations and options may be available within the scope for the present disclosure.

While the device has been shown in the attached photos as being mounted to straps made of fiber or woven materials, devices according to the present disclosure may also be used to provide shock absorption in straps made of alternative materials such as steel or other metallic compounds. Having a shock attenuation capability through use of devices according to the present disclosure may permit straps to be made of lower stretch or stronger materials. Since the device will provide the shock attenuation, the strap does not need to fulfill the dual role of supporting an object and yielding or flexing when subjected to excess force. The strap can be designed and configured to precisely hold or support the object in the desired location and the device can be configured to provide the desired amount of movement and/or shock attenuation.

The degree of strength required of the strap can be more carefully selected and the degree of movement or attenuation may be separately provided.

A device according to the present disclosure may be made of any suitable material that may have the strap interwoven through the device. It is not intended to limit the material from which the device may be made, as long as the deformation of the device provides the desired degree of movement or attenuation. Any suitable material may be used to form the device according to the present disclosure, as long as it is compatible with the material used in the strap and the environment in which the device is to be employed. For example, on a football helmet, where the device will be placed on a chin strap, the device needs to be shaped and made of a material that will not damage or reduce the effectiveness of the chin strap to secure the helmet to a player's head. The device will also preferably be made of a material that will not cut or injure the player wearing the helmet or any other players coming into contact with the wearer.

In other applications, such as industrial support applications, the device may be made of a harder material without concern for damage to adjacent equipment.

The embodiments of the inventions disclosed herein have been discussed for the purpose of familiarizing the reader with novel aspects of the present invention. Although preferred embodiments have been shown and described, many changes, modifications, and substitutions may be made by one having skill in the art without unnecessarily departing from the spirit and scope of the present invention. Having described preferred aspects and embodiments of the present invention, modifications and equivalents of the disclosed concepts may readily occur to one skilled in the art. However, it is intended that such modifications and equivalents be included within the scope of the claims which are appended hereto.

What is claimed is:

1. A shock absorbing device, comprising:

a body constructed from a deformable material, the body having a first lateral side having a first central axis and a second lateral side having a second central axis and the body having a first outer surface generally defined by a first plane generally intersecting a top surface of the first lateral side and a top surface of the second lateral side and a second outer surface generally defined by a second plane generally intersecting a bottom surface of the first lateral side and a bottom surface of the second lateral side, a plurality of ribs extending from an inner surface of the first side to an inner surface of the second side each rib having a top surface and a bottom surface, and a plurality of spaces defined by adjacent ribs; and a chin strap for a helmet extending through the spaces and having a first end extending beyond a first end of the body and a second end extending beyond a second end of the body;

wherein the first outer surface and top surface of each rib are generally coplanar in relation to one another when the chin strap is not subjected to a load;

wherein the second outer surface and bottom surface of each rib are generally coplanar in relation to one another when the chin strap is not subjected to a load; and wherein adjacent ribs are deflected in generally opposite directions when the chin strap is subjected to a load.

2. The device of claim 1, wherein the first lateral side of the body is generally linear along the first central axis and the second lateral side of the body is generally linear along the second central axis.

3. The device of claim 1, wherein the first lateral side of the body is curved along the first central axis and the second lateral side of the body is curved along the second central axis.

4. The device of claim 3, wherein the first lateral side of the body is generally ovoid along the first central axis and the second lateral side of the body is generally ovoid along the second central axis.

5. The device of claim 1, wherein the body is composed of a material in which deformation of the body in response to load is entirely within the elastic deformation range of the material.

6. The device of claim 1, wherein the body is composed of a material in which deformation of the body in response to load is entirely within the plastic deformation range of the material.

7. The device of claim 1, wherein the body is composed of a material in which deformation of the body in response to load is partially within the plastic deformation range of the material and partially within the elastic deformation range of the material.

8. The device of claim 1, wherein the chin strap is a chin strap for a sports helmet and the first end of the strap is interconnected with the sports helmet and the second end of the strap is interconnected with a chin cup, and the body is composed of a material that provides attenuation of shock loads transmitted from the helmet to the chin cup.

9. The device of claim 8, wherein the body is composed of a material that returns to its original undeformed state after the load is released.

10. The device of claim 1, wherein the number of openings is selected so that the first end and second end of the chin strap both extend from the ends of the body adjacent one of the first outer surface of the body and second outer surface of the body.

11. The device of claim 1, wherein the number of openings is selected so that the first end of the chin strap extends from the first end of the body adjacent the first outer surface of the body and the second end of the strap extends from the second end of the body adjacent the second outer surface of the body.

12. The device of claim 1, wherein the number of openings is selected so that the first end of the chin strap extends from the first end of the body adjacent the second outer surface of the body and the second end of the chin strap extends from the second end of the body adjacent the first outer surface of the body.

13. The device of claim 1, wherein a first end rib and second end rib include openings so that the chin strap extends from the ends of the body in between the first outer surface of the body and second outer surface of the body.

* * * * *